US008518128B2

(12) United States Patent
Reaney et al.

(10) Patent No.: US 8,518,128 B2
(45) Date of Patent: Aug. 27, 2013

(54) FUEL ADDITIVE COMPOSITION TO IMPROVE FUEL LUBRICITY

(75) Inventors: Martin Reaney, Saskatoon (CA); Sunmin Wang, Saskatoon (CA); Yunhua Jia, Saskatoon (CA)

(73) Assignee: University of Saskatchewan, Saskatoon, Saskatchewan (CA)

( * ) Notice: Subject to any disclaimer, the term of this patent is extended or adjusted under 35 U.S.C. 154(b) by 1144 days.

(21) Appl. No.: 12/263,749

(22) Filed: Nov. 3, 2008

(65) Prior Publication Data

US 2009/0113788 A1 May 7, 2009

Related U.S. Application Data

(60) Provisional application No. 60/984,501, filed on Nov. 1, 2007.

(51) Int. Cl.
*C10L 1/18* (2006.01)
*C10L 1/10* (2006.01)

(52) U.S. Cl.
USPC ..... 44/308; 44/306; 44/388; 44/445

(58) Field of Classification Search
USPC ..... 44/301, 302, 388, 418, 443, 306, 44/308, 445
See application file for complete search history.

(56) References Cited

U.S. PATENT DOCUMENTS

| | | | | | |
|---|---|---|---|---|---|
| 2,621,115 | A | * | 12/1952 | Van Order | 44/600 |
| 3,036,997 | A | * | 5/1962 | Campbell | 525/455 |
| 3,273,981 | A | | 9/1966 | Furey | |
| 3,658,495 | A | * | 4/1972 | Dorer, Jr. | 44/400 |
| 4,364,743 | A | * | 12/1982 | Erner | 44/388 |
| 4,920,691 | A | | 5/1990 | Fainman | |
| 5,501,714 | A | * | 3/1996 | Valentine et al. | 44/358 |
| 5,599,358 | A | | 2/1997 | Giavazzi et al. | |
| 5,713,965 | A | | 2/1998 | Foglia et al. | |
| 5,730,029 | A | | 3/1998 | Stoldt et al. | |
| 5,882,364 | A | | 3/1999 | Dilworth | |
| 6,017,369 | A | * | 1/2000 | Ahmed | 44/302 |
| 6,080,212 | A | | 6/2000 | Beimesch et al. | |
| 6,822,104 | B2 | | 11/2004 | Reaney et al. | |
| 2005/0075254 | A1 | * | 4/2005 | Pollock et al. | 508/486 |
| 2005/0160663 | A1 | * | 7/2005 | Valentine | 44/388 |
| 2006/0288637 | A1 | * | 12/2006 | Choo et al. | 44/385 |
| 2009/0113788 | A1 | | 5/2009 | Reaney et al. | |

FOREIGN PATENT DOCUMENTS

| | | |
|---|---|---|
| WO | 94/17160 | 8/1994 |

OTHER PUBLICATIONS

Munson et al., Lubricity Survey of Low-Level Biodiesel Fuel Additives Using the "Munson Rocle" Bench Test, (1999), SAE paper # 1999-01-3590.

S.L. Dmytryshyn et al. Bioresource Technology 92 (2004) 55-64.

* cited by examiner

*Primary Examiner* — James Goloboy
*Assistant Examiner* — Latosha Hines
(74) *Attorney, Agent, or Firm* — Bereskin & Parr LLP/S.E.N.C.R.L., s.r.l.; Michael Fenwick

(57) ABSTRACT

The present disclosure relates to fuel additive compositions comprising one or more hydrogen bonding compounds derived from a long chain fatty acid, and one or more esters of a second long chain fatty acid. Such fuel additives improve the lubricity of the fuel.

41 Claims, No Drawings

FUEL ADDITIVE COMPOSITION TO IMPROVE FUEL LUBRICITY

BACKGROUND

As environmental legislation in the United States and Canada has required that the sulfur content of diesel fuel be less than 15 ppm, the reduction in the sulfur content of diesel fuel has resulted in lubricity problems. It has become generally accepted that the reduction in sulfur is also accompanied by a reduction in polar oxygenated compounds and polycyclic aromatics, including nitrogen containing compounds, which is responsible for the reduced boundary lubricating ability of severely refined (low sulfur) fuels. While low sulfur content does not in itself cause lubricity problems, it has become the measure of the degree of refinement of the fuel, and this reflects the level of the removal of polar oxygenated compounds and polycyclic aromatics including nitrogen-containing compounds.

It has been found that low sulfur diesel fuels increase the sliding adhesive wear and fretting wear of pump components such as rollers, cam plate, coupling, lever joints and shaft drive journal bearings.

Nevertheless, concern for the environment has resulted in moves to significantly reduce the noxious components in emissions when fuel oils are burnt, particularly in engines such as diesel engines. Attempts are being made, for example, to minimize sulfur dioxide emissions by minimizing the sulfur content of fuel oils. Although typical diesel fuel oils have in the past contained 1% by weight or more of sulfur (expressed as elemental sulfur) it is now required to reduce the level to less than 15 ppm.

The additional refining of fuels oils, necessary to achieve these low sulfur levels, often results in a reduction in the levels of polar components. In addition, refinery processes can reduce the level of polynuclear aromatic compounds present in such fuel oils.

Reducing the level of one or more of the sulfur, polynuclear aromatic or polar components of diesel fuel oil can reduce the ability of the oil to lubricate the injection system of the engine. As a result of poor fuel lubrication properties, the fuel injection pump of the engine may fail relatively early in the life of the engine. Failure may occur in fuel injection systems such as high-pressure rotary distributors, in-line pumps and injectors. The problem of poor lubricity in diesel fuel oils is likely to be exacerbated by future engine developments, aimed at further reducing emissions, which will result in engines having more exacting lubricity requirements than present engines. For example, the advent of high-pressure unit injectors increases the fuel oil lubricity requirement. Similarly, poor lubricity can lead to wear problems in other mechanical devices dependent on the lubrication of the natural lubricity of fuel oil.

Lubricity additives for fuel oils have been described in the art. WO 94/17160 describes an additive, which comprises an ester of a carboxylic acid and an alcohol, wherein the acid has from 2 to 50 carbon atoms and the alcohol has one or more carbon atoms. Glycerol monooleate is an example. Although general mixtures were contemplated, no specific mixtures were disclosed. While glycerol monooleate has good lubricity properties, it is also very polar and can form emulsions with fuel and water.

U.S. Pat. No. 3,273,981 discloses a lubricity additive that is a mixture of A+B wherein A is a polybasic acid, or a polybasic acid ester made by reacting the acid with C1-C5 monohydric alcohols; while B is a partial ester of a polyhydric alcohol and a fatty acid, for example glyceryl monooleate, sorbitan monooleate or pentaerythitol monooleate. The mixture finds application in jet fuels. Such high polarity fuel additives act as detergents and are only weakly soluble in fuel.

U.S. Pat. No. 6,080,212 teaches the use of two esters with different viscosities in diesel fuel to reduce smoke emissions and increase fuel lubricity. In a preferred embodiment, methyl octadecenoate, a major component of biodiesel, was included in the formula. Similarly, U.S. Pat. No. 5,882,364 also describes a fuel composition comprising middle distillate fuel oil and two additional lubricating components. Those components being (a) an ester of an unsaturated monocarboxylic acid and a polyhydric alcohol and (b) an ester of a polyunsaturated monocarboxylic acid and a polyhydric alcohol having at least three hydroxy groups.

The approach of using a two component lubricity additive was pioneered in U.S. Pat. No. 4,920,691. The inventors here describe an additive and a liquid hydrocarbon fuel composition consisting essentially of a fuel and a mixture of two straight chain carboxylic acid esters, one having a low molecular weight and the other having a higher molecular weight.

In U.S. Pat. No. 5,713,965, the synthesis of alkyl esters from animal fats, vegetable oils, rendered fats and restaurant grease is described. The resultant alkyl esters are reported to be useful as additives to automotive fuels and lubricants.

Alkyl esters of fatty acids derived from vegetable oleaginous seeds were recommended at rates between 100 to 10,000 ppm to enhance the lubricity of motor fuels in U.S. Pat. No. 5,599,358. Similarly, a fuel composition was disclosed in U.S. Pat. No. 5,730,029, comprising low sulfur diesel fuel and esters from the transesterification of at least one animal fat or vegetable oil triglyceride.

SUMMARY OF THE DISCLOSURE

In the present disclosure, it has been found that particular additives, when combined in adventitious ratios, possess synergistic lubricant enhancing characteristics. Specifically, it has been established that mixtures of at least two classes of compounds that can be dissolved in a petroleum distillate fuel increase the lubricity of the fuel. The first class of compounds possess at least one free hydrogen moiety capable of hydrogen bonding yet have sufficiently low polarity that they form solutions when mixed with petroleum distillate fuels at concentrations of up to about 1% (v/v). The second class of compounds are hydrophobic fatty acid esters that are miscible with petroleum distillate fuels.

Accordingly, a fuel additive composition is disclosed which comprises one or more hydrogen bonding compounds derived from a first long chain fatty acid, selected from a fatty acid alcohol, amine, amide, imide or Diels-Alder adduct and one or more esters of a second long chain fatty acid, wherein the hydrogen bonding compounds and the esters are soluble in petroleum distillate fuels and the first and second long chain fatty acids are the same or different The fuel additive composition is added to the fuel to decrease friction and wear that occurs in pumps, engines, motors, valves and other mechanical parts that are in contact with a petroleum distillate and are lubricated, at least in part, by the distillate.

The combination of a hydrogen bonding compound and fatty acid ester compound have additional beneficial characteristics that increase their efficacy in many applications. The compounds have elevated solubility in hydrocarbon fuels when compared with other lubricity-improving additives. This solubility property allows the additives to be introduced into fuel at relatively high concentrations that provide additional lubricant and combustion benefits.

The fuel additive compositions are also biodegradable and thus are rapidly decomposed in the environment. Further, the fuel additive compositions have low solubility in water and cannot be removed from the blend by contact between distillate fuel and water.

The present disclosure also includes petroleum distillate fuels comprising an additive composition described herein. Also included is a method for increasing the lubricity of a petroleum distillate fuel comprising adding a lubricating-effective amount of an additive composition described herein to said fuel.

Other features and advantages of the present disclosure will become apparent from the following detailed description. It should be understood, however, that the detailed description and the specific examples while indicating preferred embodiments of the disclosure are given by way of illustration only, since various changes and modifications within the spirit and scope of the disclosure will become apparent to those skilled in the art from this detailed description.

DETAILED DESCRIPTION OF THE DISCLOSURE DEFINITIONS

The term "fuel" as used herein refers to petroleum distillate fuels having sulfur content of less than or equal to 0.2% by weight.

The term "lubricating-effective amount" as used herein is a quantity sufficient to, when included in a fuel of the present disclosure, effect desired or beneficial lubricating effects. For example, a lubricating-effective amount is an amount of the additive composition of the present disclosure to achieve any increase in lubricity of a fuel compared to the lubricity obtained without addition of the additive composition of the present disclosure.

The term "soluble" as used herein means that an effective amount of a substance will dissolve to provide an substantially homogeneous solution in a desired liquid.

The term "fatty acid" as used herein refers to aliphatic monocarboxylic acids, derived from, or contained in esterified form in an animal or vegetable fat, oil or wax. Natural fatty acids typically have a chain of 4 to 28 carbons (usually unbranched and even numbered), which may be saturated or unsaturated.

The term "Diels Alder adduct" as used herein refers to a compound prepared from the reaction of a diene and a dienophile (typically a double bond-containing compound such as alkene) under Diels Alder reaction conditions.

The term "alcohol" as used herein refers to the chemical group "—OH".

The term "amine" as used herein refers to the chemical grouping $N(R^a)_2$", wherein $R^a$ is H, substituted or unsubstituted $C_{1-20}$alkyl or substituted or unsubstituted aryl and each $R^a$ is the same or different.

The term "amide" as used herein refers to the chemical grouping "—$C(O)N(R^b)_2$", wherein $R^b$ is H, substituted or unsubstituted $C_{1-20}$alkyl or substituted or unsubstituted aryl and each $R^b$ is the same or different The term "imide" as used herein refers to the chemical grouping "—C(O)—$NR^c$—C(O)—", wherein $R^c$ is H, substituted or unsubstituted $C_{1-20}$alkyl or substituted or unsubstituted aryl.

The term "substituted" as used herein, unless otherwise indicated, means that the group is substituted with one to three substituents independently selected from halo, halo-substituted $C_{1-4}$alkyl, aryl, alkyl-substituted aryl and halo-substituted aryl.

The term "$C_{m-n}$alkyl" as used herein means straight and/or branched chain, saturated alkyl radicals containing from "m" to "n" carbon atoms and includes (depending on the identity of m and n) methyl, ethyl, propyl, isopropyl, n-butyl, s-butyl, isobutyl, t-butyl, 2,2-dimethylbutyl, n-pentyl, 2-methylpentyl, 3-methylpentyl, 4-methylpentyl, n-hexyl and the like, where the variable m is an integer representing the smallest number of carbon atoms in the alkyl radical and n is an integer representing the largest number of carbon atoms in the alkyl radical.

The term "$C_{m-n}$alkenyl" as used herein means straight and/or branched chain, unsaturated alkyl radicals containing from "m" to "n" carbon atoms and one to three double bonds, and includes (depending on the identity of m and n) vinyl, allyl, 2-methylprop-1-enyl, but-1-enyl, but-2-enyl, but-3-enyl, 2-methylbut-1-enyl, 2-methylpent-1-enyl, 4-methylpent-1-enyl, 4-methylpent-2-enyl, 2-methylpent-2-enyl, 4-methylpenta-1,3-dienyl, hexen-1-yl and the like, where the variable m is an integer representing the smallest number of carbon atoms in the alkenyl radical and n is an integer representing the largest number of carbon atoms in the alkenyl radical.

The term "$C_{m-n}$alkynyl" as used herein means straight and/or branched chain, unsaturated alkyl radicals containing from "m" to "n" carbon atoms and one to three triple bonds, and includes (depending on the identity of m and n) propargyl, but-1-ynyl, but-2-ynyl, but-3-ynyl, 4-methylpent-1-ynyl, 4-methylpent-2-ynyl, hex-1-ynyl and the like, where the variable m is an integer representing the smallest number of carbon atoms in the alkynyl radical and n is an integer representing the largest number of carbon atoms in the alkynyl radical.

The term "aryl" as used herein means a monocyclic, bicyclic or tricyclic carbocyclic ring system containing from 6 to 14 carbon atoms and in which at least one ring is aromatic and includes phenyl, naphthyl, anthracenyl, 1,2-dihydronaphthyl, 1,2,3,4-tetrahydronaphthyl, fluorenyl, indanyl, indenyl and the like.

The term "halo-substituted" as used herein means that one or all of the hydrogen atoms in the claimed radical have been replaced with a halogen atom, suitably, fluorine.

The term "alkyl-substituted" as used herein means that one or more, suitably 1 to 5, more suitably 1 to 3, of the hydrogen atoms in the claimed radical have been replaced with a $C_{1-4}$alkyl group, suitably, methyl.

The term "hydroxy-substituted" as used herein means that one or more, suitably 1 to 5, more suitably 1 to 3, of the hydrogen atoms in the claimed radical have been replaced with a hydroxy (OH) group.

The term "alkoxy-substituted" as used herein means that one or more, suitably 1 to 5, more suitably 1 to 3, of the hydrogen atoms in the claimed radical have been replaced with a $C_{1-6}$alkoxy group, suitably, methoxy.

The term "halo" as used herein means halogen and includes chloro, fluoro, bromo and iodo.

Unless otherwise stated, all percentages defined herein are in units of volume/volume (v/v).

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Finally, terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

Fuel Additive Compositions

In an embodiment of the present disclosure, the fuel additive compositions comprise one or more hydrogen bonding compounds derived from a first long chain fatty acid, selected from a fatty acid alcohol, amine, amide, imide or Diels-Alder adduct and one or more esters of a second long chain fatty acid, wherein the hydrogen bonding compounds and the esters are soluble in petroleum distillate fuels and the first and second long chain fatty acids are the same or different.

In a suitable embodiment of the present disclosure, the long chain fatty acids are from vegetable oils. In a subsequent embodiment of the present disclosure, the long chain fatty acids are from tall, soybean, canola, palm, sunflower, rapeseed, flaxseed, corn or coconut oil. In a further embodiment of the present disclosure, the long chain fatty acids are from animal fats or greases. In a subsequent embodiment, the animal fat or grease is from swine, poultry and beef.

In a suitable embodiment of the present disclosure, the one or more hydrogen bonding compounds have sufficiently low polarity that they are soluble in petroleum distillate fuels at concentrations equal to or less than 1% (v/v).

In another embodiment of the present disclosure, the one or more hydrogen bonding compound is an amide of the first long chain fatty acid. In a further embodiment of the present disclosure, the one or more hydrogen bonding compounds are ethanolamides of the first long chain fatty acid. The ethanolamide of the first long chain fatty acid is produced from the reaction of ethanolamine and the first long chain fatty acid in the presence of suitable basic catalyst. In a suitable embodiment, the first long chain fatty acid is erucic acid.

In another embodiment of the present disclosure, the one or more hydrogen bonding compound is an imide derivative of the first long chain fatty acid. In a subsequent embodiment, the first long chain fatty acid comprises a conjugated diene when the hydrogen bonding compound is an imide. In a suitable embodiment, the conjugated diene is conjugated linoleic acid or conjugated linolenic acid. In a subsequent embodiment, the imide is produced by the Diels-Alder condensation of a maleimide derivative and the conjugated diene. In a subsequent embodiment, the maleimide derivative is an N—$C_{1-6}$alkyl derivative or an N-aryl-derivative. In a suitable embodiment, the N-aryl derivative is N-phenyl maleimide.

In another embodiment, the one or more hydrogen bonding compounds is a polyol ester of a long chain fatty acid. By polyol it is meant a straight-chain, branched-chain, cyclic, saturated or unsaturated hydrocarbon compound comprising more than one hydroxyl (OH) group. Examples of polyols include, but are not limited to glycerol, ethylene glycol, diethylene glycol, triethylene glycol and polyethylene glycol (PEG). In another embodiment, the polyol is of the formula —$O(CH_2CH_2O)_nCH_2CH_2OH$, where n is an integer from 0 to 5. Suitably n is 1.

In an embodiment of the present disclosure, the one or more hydrogen bonding compounds are selected from compounds of Formula I:

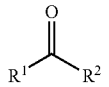

(I)

wherein $R^1$ is selected from $C_{6-24}$alkyl, $C_{6-24}$alkenyl and $C_{6-24}$-alkynyl, all of which are unsubstituted or substituted with one to three substituents independently selected from halo, halo-substituted $C_{1-4}$alkyl, aryl, alkyl-substituted aryl and halo-substituted aryl, or $R^1$ is interrupted by one or two cyclohexyl or cyclohexenyl groups both of which are unsubstituted or substituted with one to three substituents independently selected from halo, halo-substituted $C_{1-4}$alkyl, aryl, alkyl-substituted aryl and halo-substituted aryl or the one or two cyclohexyl or cycloyhexenyl groups are part of a bi- or tricyclic fused ring system which optionally contains an N atom in place of one to three carbon atoms and is unsubstituted or substituted with one to three substituents independently selected from halo, halo-substituted $C_{1-4}$alkyl, aryl, alkyl-substituted aryl and halo-substituted aryl;

$R_2$ is selected from $OC_{1-6}$alkyl, O—$C_{1-6}$alkenyl, $NHC_{1-6}$alkyl, NH—$C_{1-6}$alkenyl, NH-hydroxy-substituted $C_{1-6}$alkyl, $O(CH_2CH_2O)_nCH_2CH_2OH$, O—$CH_2CHOHCH_2OH$; and n is an integer from 0 to 5, provided that at least one of $R^1$ and $R^2$ contains a hydrogen atom that is free to participate in a hydrogen bond.

It is an embodiment of the disclosure $R^1$ is selected from $C_{6-24}$alkyl and $C_{6-24}$alkenyl, both of which are unsubstituted or substituted with one to two substituents independently selected from halo, halo-substituted $C_{1-4}$alkyl, phenyl, alkyl-substituted phenyl and halo-substituted phenyl, or $R^1$ is interrupted by one or two cyclohexyl or cyclohexenyl groups both of which are unsubstituted or substituted with one to two substituents independently selected from halo, halo-substituted $C_{1-4}$alkyl, phenyl, alkyl-substituted phenyl and halo-substituted phenyl or the one or two cyclohexyl or cycloyhexenyl groups are part of a bi- or tricyclic fused ring system which optionally contains an N atom in place of one carbon atom and is unsubstituted or substituted with one to two substituents independently selected from halo, halo-substituted $C_{1-4}$alkyl, phenyl, alkyl-substituted phenyl and halo-substituted phenyl.

In another embodiment, $R_2$ is selected from $OC_{1-4}$alkyl, O—$C_{1-4}$alkenyl, $NHC_{1-4}$alkyl, NH—$C_{1-4}$alkenyl, NH-hydroxy-substituted $C_{1-4}$alkyl, $O(CH_2CH_2O)_nCH_2CH_2OH$, O—$CH_2CHOHCH_2OH$, and n is an integer from 0 to 3.

In particularly suitable embodiments of the present disclosure, the one or more hydrogen bonding compounds are selected from

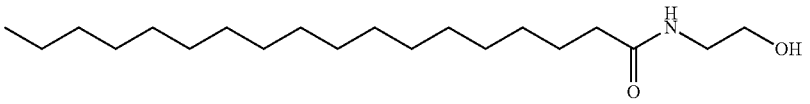

-continued

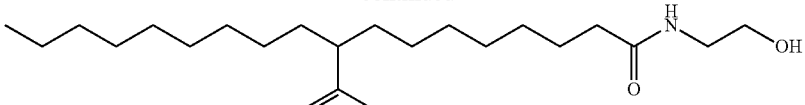

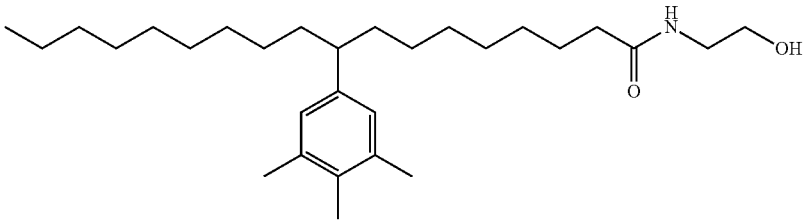

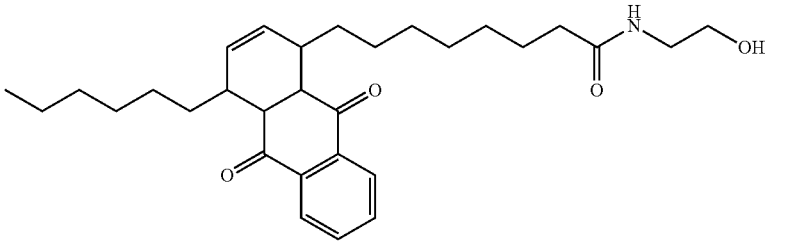

and

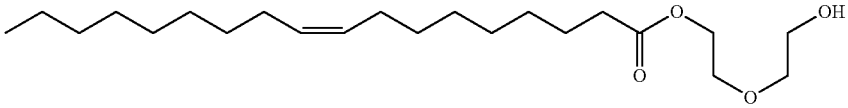

In a suitable embodiment of the disclosure, the one or more hydrogen bonding compounds are present in the fuel additive composition in an amount from 1 to 99 percent by weight of the fuel additive. In another embodiment, the hydrogen bonding compound in the additive is included at 50% by weight of the additive. In another embodiment the hydrogen bonding compound in the additive is included at 10 percent by weight of the additive.

In an embodiment of the present disclosure, the one or more esters of a second long chain fatty acid are miscible with petroleum distillate fuels or have solubility of at least 5 percent in petroleum distillate fuels. In a subsequent embodiment, the one or more esters of a second long chain fatty acid are soluble in petroleum distillate fuels comprising the hydrogen bonding compounds.

In an embodiment of the disclosure, the second long chain fatty acid is from a vegetable oil or animal fat.

In another embodiment, the vegetable oil is tall, soybean, canola, palm, sunflower, rapeseed, flaxseed, corn, mustard seed, safflower, crambe or coconut oil.

In a suitable embodiment of the present disclosure, the second long chain fatty acid is from canola oil.

In another embodiment of the present disclosure, the one or more esters of a second long chain fatty acid are $C_{1-6}$alkyl esters of the second long chain fatty acid. In a specific embodiment, the one or more $C_{1-6}$alkyl esters are methyl esters. In a subsequent embodiment, the one or more esters of a second long chain fatty acid are aryl esters of the second long chain fatty acid.

In another embodiment, the one or more esters of a second long chain fatty acid also comprise an ether in the ester moiety. In a subsequent embodiment, the ether group is a monoalkoxy ether derived from a glycol. In a specific embodiment of the present disclosure, the monoalkoxy ether is methoxy-2-propyl alcohol.

In another embodiment of the present disclosure, the one or more esters of a second long chain fatty acid are a cellosolve ($OCH_2CH_2OR$, R═$C_{1-6}$alkyl) ester of the second long chain fatty acid. In a specific embodiment, the cellosolve ester is butyl cellosolve ($OCH_2CH_2OCH_2CH_2CH_2CH_3$).

In another embodiment of the present disclosure the esters of a second long chain fatty acid are carboxylic acid esters of a propylene ether and the second long chain fatty acid.

In a further embodiment, the one or more esters of a second long chain fatty acid are carboxylic acid esters of a polyether and the second long chain fatty acid. In specific embodiments, the polyether is a monoalkyl ether substituted polyethylene glycol or a monoalkyl ether substituted polypropylene glycol where the glycol mass is less than 600 daltons.

In another embodiment of the present disclosure, the one or more esters of a second long chain fatty acid are the methoxy-2-propyl ester of a fatty acid from canola oil.

In an embodiment of the present disclosure, the one or more esters of a second long chain fatty acid are selected from compounds of Formula II:

(II)

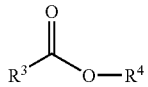

$R^3$ is selected from $C_{6-24}$alkyl, $C_{6-24}$alkenyl and $C_{6-24}$-alkynyl, all of which are unsubstituted or substituted with one to three substituents independently selected from halo, halo-substituted $C_{1-4}$alkyl, aryl, alkyl-substituted aryl and halo-substituted aryl; and $R^4$ is selected from $C_{1-6}$alkyl, $C_{1-6}$alkenyl, halo-substituted $C_{1-6}$alkyl, hydroxy-substituted $C_{1-6}$alkyl, alkoxy-substituted $C_{1-6}$alkyl, aryl, hydroxy-substituted aryl, alkoxy-substituted aryl, halo-substituted aryl and polyethers.

In an embodiment of the disclosure, $R^3$ is selected from $C_{6-24}$alkyl and $C_{6-24}$ alkenyl, both of which are unsubstituted or substituted with one to two substituents independently selected from halo, halo-substituted $C_{1-4}$alkyl, phenyl, alkyl-substituted phenyl and halo-substituted phenyl.

In another embodiment of the disclosure, $R^4$ is selected from $C_{1-4}$alkyl, $C_{1-4}$alkenyl, halo-substituted $C_{1-4}$alkyl, hydroxy-substituted $C_{1-4}$alkyl, alkoxy-substituted $C_{1-4}$alkyl, phenyl, hydroxy-substituted phenyl, alkoxy-substituted phenyl, halo-substituted phenyl and polyethers.

In a particular embodiment of the present disclosure, the one or more ester-containing compounds have the following structure:

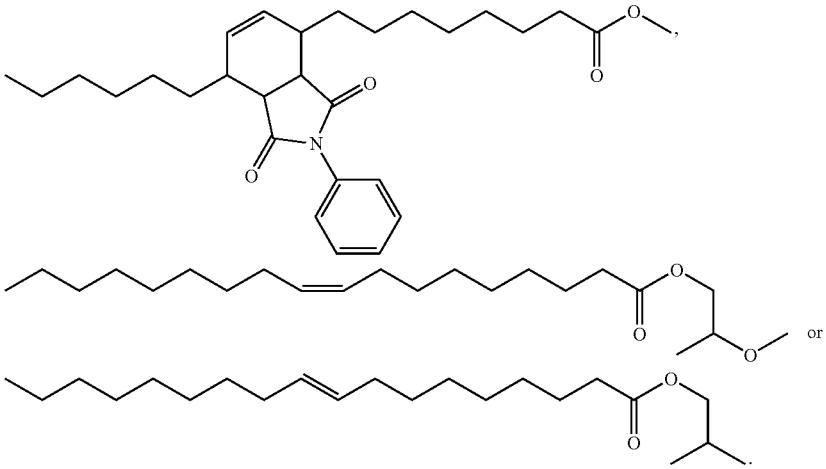

In a suitable embodiment of the disclosure, the one or more esters of a second long chain fatty acid are present in the fuel additive composition in an amount from 1 to 99 percent by weight of the fuel additive. In another embodiment the ester containing compound is 50 percent of the weight of the additive. In another embodiment the ester is 90 percent of the weight of the additive.

In another embodiment of the present disclosure, the fuel additive compositions gain additional benefit by the addition of a solvent that also contains an ether. In a subsequent embodiment, an ether is added as a third component to the fuel additive, the ether characterized in that it can specifically lower the freezing point, cloud point and/or pour pint of the fuel additive. In a specific embodiment of the present disclosure, methyl tertiary butyl ether (MTBE) is added to the one or more esters of a second long chain fatty acid.

In an embodiment of the present disclosure the one or more esters of a second long chain fatty acid have a cloud point of about −15° C. to about −20° C., suitably about −18° C., and a pour point of about −25° C. to about −30° C., suitably about −27° C. In a further embodiment, the one or more esters of a second long chain fatty acid in combination with a solvent has a cloud point of about −20° C. to about −30° C., suitably about −21° C. to about −24° C., and a pour point of about −30° C. to about −50° C., suitably about −36° C. to about −45° C. The low temperature properties of the ether-containing additive and solvent allow the use of the additive at lower temperatures.

In a suitable embodiment, the fuel additive compositions also comprise a detergent.

In further embodiments of the present disclosure, the petroleum distillate fuel is gasoline, diesel, jet, kerosene, biodiesel, propane or ethanol containing fuel for gasoline engines.

The present disclosure also includes petroleum distillate fuels comprising an additive composition described herein. In an embodiment, the fuel comprises a lubricating effective amount of an additive composition disclosed herein. In a further embodiment, the fuel comprises from about 0.01% to about 5% (v/v), suitably from about 0.05% to about 0.2% (v/v), of an additive composition of the present disclosure.

Also included is a method for increasing the lubricity of a petroleum distillate fuel comprising adding a lubricating-effective amount of an additive composition described herein to said fuel.

The following non-limiting examples are illustrative of the present disclosure:

EXAMPLES

Materials and Methods

Cold Flow Properties Measurements:

Cold flow properties were measured using a refrigerated bath (Serial#90FMS33990-1, Neslab Instruments, Inc., Newington, N.H., USA) which is circulated with ethylene glycol. Between 15 and 25 mL of ester sample was placed into a glass test tube which measures 26 mm in diameter. The test tube containing the sample was then put into a 100 ml volumetric cylinder which was placed deep into the refrigerated bath. The experimental settings and measurement procedures largely followed those of standard method ASTM D97. At every 3° C. of cooling, the sample is inspected. The cloud point is determined by visually inspecting for a haze in the sample. Pour point is determined by adding 3° C. to the temperature at which no sample movement is detected after the glass tube is tilted for five seconds.

Lubricity Analysis on the m-ROCLE:

Lubricity is measured using a Munson Roller On Cylinder Lubricity Evaluator (M-ROCLE; Munson, J. W., Hertz, P. B., Dalai, A. K. and Reaney, M. J. T. Lubricity survey of low-level biodiesel fuel additives using the "Munson ROCLE" bench test, SAE paper 1999-01-3590). The M-ROCLE test apparatus conditions are given in Table 1. During the test, the reaction torque was proportional to the friction force produced by the rubbing surfaces and was recorded by a computer data acquisition system. The recorded reaction torque was used to calculate the coefficient of friction with the test fuel. Each wear scar produced is elliptical in shape. Major and minor axes are measured at 100 times magnification through a microscope. The wear scar area is calculated from the formula for an ellipse. After determining the unlubricated Hertzian contact stress, a dimensionless lubricity number (LN), indicating the lubricating property of the test fuel, was determined using the following equation:

$$LN = \frac{\sigma_{SS}}{\sigma_H \times \mu_{ss}}$$

and $$\sigma_{SS} = PIA$$

where $\sigma_{SS}$ is the steady state ROCLE contact stress (MPa), $\sigma_H$ is the Hertzian theoretical elastic contact stress (MPa), $\mu_{SS}$ is the steady state coefficient of friction, P is the applied load (N) and A is the roller scar area ($m^2$).

The reference or base fuel used was pre-production, unadditized ultra low sulphur diesel fuel (containing less than 15 ppm sulphur), which was provided by Alberta Research Council (Alberta, Canada). Each fuel ester sample was lubricity tested six times on the machine followed by a calibration of the reaction torque.

Example 1

Two Stage Interesterification of Canola Based Methyl Ester with 1-methoxy-2-propanol and Potassium Methylate Catalyst Alcohol ether enriched esters were prepared using a two-stage base catalysed alcoholysis process. The two-stage reaction was required to progressively remove a great majority of methyl group from the methyl ester and exchange it with an acyl group from 1-methoxy-2-propanol alcohol. A 1.2:1 molar ratio of 1-methoxy-2-propanol to methyl ester was used. In the first stage reaction, 20 mL methyl ester was reacted with 6.99 mL 1-methoxy-2-propanol (>99.5%, ReagentPlus, Dow Chemical) and 0.56 mL of potassium methylate catalyst (BASF Chemical Company). The catalyst solution contains approximately 30% (w/w) of potassium methylate in methanol. The reaction was carried out at 85-90° C. for 1.25 hour in a 40 mL test tube. Nitrogen was distributed to the reaction media in order to facilitate removal of the methanol produced and to assist agitation. In the second stage reaction, 6.99 mL 1-methoxy-2-propanol and 0.56 mL of potassium methylate catalyst was added to the reaction media. The reaction was carried out at 85-90° C. for 1.25 hour in a 40 mL test tube. The reaction media was then neutralized with hydrochloric acid solution followed by water wash to remove residual catalysts and excess 1-methoxy-2-propanol. The purified esters were analysed for conversion rate by $^1H$ Nuclear Magnetic Resonance Spectroscopy method (Univ. of Saskatchewan, SK, Canada).

The resulting esters contained approximately 85% alcohol ether and 15% un-converted methyl ester. The product had a cloud point at −18° C. and a pour point of −27° C., which are significantly below the cloud point (−12° C.) and pour point (−12° C.) recorded for the starting methyl ester.

Example 2

Three Stage Interesterification of Canola Based Methyl Ester with 1-methoxy-2-propanol and Potassium Methylate and Metal Sodium Catalysts All processes and conditions for the first two-stage reactions were identical to those described in Example 1. An alternate base catalyst was used in the third stage reaction. Approximately 0.05 grams of freshly cut metal sodium was first dissolved in 4 mL 1-methoxy-2-propanol. The catalyst solution was then added to the reaction media. The third stage reaction was carried out at 85-90° C. for 1.5 hour. Again, nitrogen source was introduced to the reaction media to assist the agitation and the removal of the forming methanol. The resulting esters were neutralized and purified following identical procedures described in Example 1.

The resulting esters contained approximately 91% alcohol ether and 9% un-converted methyl ester. The product had a cloud point at −18° C. and a pour point of −27° C., which are significantly below the cloud point (−12° C.) and pour point (−12° C.) recorded for the starting methyl ester.

A three-stage interesterification reaction results in more consistent and higher methyl ester to alcohol ether conversion rates. Although an increase of conversion rate from 85 to 91% did not lead to further improvement on cloud and pour point.

Example 3

Improvement of Cloud and Pour Point by the Addition of an Ether Solvent

Addition of an ether solvent such as MTBE (tert-Butyl methyl ether, 99+%, A.C.S. reagent, Sigma) to the alcohol ether samples produced in Example 1 and Example 2 at 15% v/v (volume of MTBE over volume of MTBE+alcohol ether), lowered cloud points from −18° C. to between −21 and −24° C., and pour points from −27° C. to between −36 and −45° C.

Example 4

Production of Diels-Alder Adduct of N-Phenyl Maleimide and Conjugated Linoleic Acid Ethyl cis, trans-conjugated linoleate made from safflower oil (Reaney et al. U.S. Pat. No. 6,822,104 B2) was isomerized to ethyl trans,trans-linoleate catalyzed by iodine (5% mole ratio; IDESES, R.; A. SHANI. Study of the radical mechanism of iodine-catalized isomerization of conjugated diene systems. J. Am. Oil Chem. Soc., 1989. 66(7): p. 948-952). It was found that the protons attached to conjugated double bonds of cis, trans-linoleate found at 6.31, 5.96, 5.68, 5.31 ppm were greatly diminished and that new signals attributable to ethyl trans, trans-linoleate had appeared at 6.02 and 5.58 ppm. The resulting ethyl trans, trans-linoleate was diluted with dichloromethane and mixed well with N-phenyl maleimide and then the dichloromethane was removed by rotary evaporator. The reaction was conducted at 60° C. for 24 hours under $N_2$ atmosphere. The crude Diels-Alder adduct was formed and purified using silica chromatography with solvent system of 10% ethyl acetate in hexane. The Diels-Alder adduct was identified by new $^1H$ NMR signals at 5.83 (s) and 3.27 ppm and the peaks for protons at the conjugated double bonds of ethyl conjugated linoleate disappeared. In addition, mass spectrometry (EI) also gave the correct molecular weight of 481.3205 for the Diels-Alder adduct of N-phenyl maleimide and ethyl conjugated linoleate.

Example 5 m-ROCLE Lubricity Analysis of Diesel Fuel Containing methoxy-2-propanol Esters from Example 2

Lubricity was measured using a Munson Roller On Cylinder Lubricity Evaluator (M-ROCLE; Munson, J. W., Hertz, P. B., Dalai, A. K. and Reaney, M. J. T. Lubricity survey of low-level biodiesel fuel additives using the "Munson ROCLE" bench test, SAE paper 1999-01-3590). The M-ROCLE test apparatus conditions are given in Table 1. M-ROCLE operation and equations used to describe lubricity number are described above.

A total of 6 replications were performed to allow for statistical analysis. All tests were performed on a 1% solution of concentrate or distillate in kerosene. Table 2 contains the results of analyses.

In testing it was found that lubricity numbers of the reference ultra low sulphur diesel (ULSD) fuel were significantly improved when it was incorporated with 1% alcohol ethers. Addition of methoxy-2-propanol ester of example 2 to the diesel fuel also reduced wear scar area and to lesser extent coefficient of friction.

Example 6 m-ROCLE Lubricity Analysis of Pre-production Diesel Fuel Containing methoxy-2-propanol Esters from Example 2

Lubricity measurements for pre-production ultra low sulfur diesel fuel (ULSD & 100 ppm acylethanolamides containing methoxy-2-propanol ester from Example 2 additives were performed as described in Example 5. It was found that lubricity numbers of the pre-production ULSD were improved when it was incorporated with 0.1% methoxy-2-propanol ester of Example 2 (Table 3). Wear scar areas were also reduced as a result of the combined additives. Thus the combination of the additives acylethanolamide and methoxy-2-propanol ester of Example 2 provides synergistic lubricant enhancing characteristics. This quality trait has not been previously reported. It was noted that methoxy-2-propanol ester of Example 2 addition from 0.1 to 0.2% did not result in further improvement in lubricity properties.

Example 7 m-ROCLE Lubricity Analysis of Pre-production Diesel Fuel Containing methoxy-2-propanol Esters from Example 2 Combined with MTBE Lubricity measurement for the pre-production ultra low sulfur diesel fuel (ULSD & 100 ppm acylethanolamide; AEA) combined with MTBE and methoxy-2-propanol ester of Example 2 were performed as described in Example 5. It was found that addition of MTBE at 0.05% improved lubricity characteristics of the pre-production ULSD. However the combined additives of MTBE and methoxy-2-propanol ester of Example 2 at current levels (Table 4) did not show a synergistic lubricant enhancing effect.

Example 8

HFRR Lubricity Analysis of Diesel Fuel Combined with methoxy-2-propanol Ester of Example 2

The High Frequency Reciprocating Rig or HFRR has been the most widely used lubricity bench test. These tests are conducted according to standard methods (CEC F-06-A-96. Measurement of Diesel Fuel Lubricity-Approved Test Method. HFRR Fuel Lubricity Test.)

The HFRR results are summarized in Table 5 and Table 6. They were compared to the results obtained by the m-ROCLE method (Table 3 and 4). Trends in lubricity improvement due to the addition of methoxy-2-propanol ester of Example 2 were similar from both m-ROCLE (Table 3) and HFRR (Table 5) methods. The improvement in lubricity was illustrated by reduction in wear scar diameters and its component major and minor axes. Combined additions of methoxy-2-propanol ester of Example 2 and MTBE to the pre-production commercial ULSD resulted in further reduction in major and minor axis and subsequent wear scar diameters (compare Tables 4 and 6).

Example 9

Isolation and its Structure Analysis of a Lubricity Additive in Diesel Fuel

Diesel (500 mL) from a Canadian supplier (Bus Grade, Dec 7/06) was poured into a column with packed dry silica gel (40 g). First, 150 mL of the diesel fraction after passing through dry silica gel was used for the lubricity tests. Once the diesel sample passed through silica gel and the more polar compounds were absorbed onto silica gel, hexane (100 mL) was used to elute less polar compounds. Subsequently, increasing polarity solvent systems: 5% EtOAc in hexane (250 mL, F1), 20% EtOAc in hexane (250 mL, F2), 50% EtOAc in hexane (250 mL, F3) and 20% MeOH in dichloromethane (250 mL, F4), were used to obtain four fractions (F1-F4) and to prepare proton-NMR samples for analysis. From proton NMR (Jia-01-161(9)), fraction 4 contained the lubricant additive with trace impurity and was purified further by preparative TLC with developing solvent: 5% MeOH in dichloromethane (developed 3×). Pure compound (32.0 mg, 78 ppm) was obtained and prepared for spectral analysis including ($^1$H, COSY, APT, $^{13}$C, IR). Based on NMRand IR spectra analysis, the structure of the compound was R—$OCH_2CH_2OCH_2CH_2OH$(R=FATTY ACIDS of which the majority were oleic and linoleic acid from GC analysis). The lubricity of the diesel fuel with no additive was very poor. HFRR tests showed this fuel a large wear scar of 730 microns in diameter. Addition of the methoxy-2-propyl esters of fatty acids to this diesel fuel improved the HFRR wear scar by reducing it to 700 microns in diameter. The commercial diesel containing the hydrogen bonding lubricity additive alone produced a significant reduction in wear scar area. The wear scar was just 590 microns. Surprisingly fuels that contained both additives (methoxy-2-propyl esters and H-bonding addivitve) had greatly reduced wear scars of just 500 microns.

While the present disclosure has been described with reference to what are presently considered to be the preferred examples, it is to be understood that the disclosure is not limited to the disclosed examples. To the contrary, the disclosure is intended to cover various modifications and equivalent arrangements included within the spirit and scope of the appended claims.

All publications, patents and patent applications are herein incorporated by reference in their entirety to the same extent as if each individual publication, patent or patent application was specifically and individually indicated to be incorporated by reference in its entirety. Where a term in the present application is found to be defined differently in a document incorporated herein by reference, the definition provided herein is to serve as the definition for the term.

TABLE 1

| M-ROCLE TEST CONDITIONS | |
|---|---|
| Fuel temperature, ° C. | 25 ± 1.5 |
| Fuel capacity, mL | 63 |
| Ambient temperature, ° C. | 24 ± 1.0 |
| Ambient humidity, % | 35-45 |

TABLE 1-continued

| M-ROCLE TEST CONDITIONS | |
|---|---|
| Applied load, N | 24.6 |
| Load application velocity, mm/s | 0.25 |
| Test duration, min | 3 |
| Race rotational velocity, rpm | 600 |
| Race Surface velocity, m/s | 1.10 |
| Test specimens | |
| Falex test cylinder, F-S25 test rings, SAE 4620 steel | |
| Outer diameter, mm | 35.0 |
| Width, mm | 8.5 |
| Falex tapered test rollers, F-15500, SAE 4719 steel | |
| Outer diameter, mm | 10.18, 10.74 |
| Width, mm | 14.80 |

TABLE 2

LUBRICITY DATA OF DIESEL FUEL CONTAINING METHOXY-2-PROPANOL ESTERS

| Samples | Lubricity Number (n = 6) | Standard Deviation | Wear Scar Area (n = 6) ($mm^2$) | Standard Deviation ($mm^2$) | Coefficient of Friction (n = 6) | Standard Deviation |
|---|---|---|---|---|---|---|
| 100% Ultra Low Sulphur Diesel Fuel (reference) | 0.622 | 0.048 | 0.360 | 0.022 | 0.123 | 0.005 |
| 99% Ultra Low Diesel Fuel, 1% methoxy-2-propyl ester of Example 2 | 0.971 | 0.034 | 0.255 | 0.009 | 0.110 | 0.001 |
| 99% Ultra Low Diesel Fuel, 1% methoxy-2-propyl ester of Example 2 | 0.938 | 0.066 | 0.250 | 0.017 | 0.117 | 0.001 |

TABLE 3

Lubricity Characteristics of Pre-production Ultra Low Sulfur Diesel Fuel Containing 100 ppm Acylethanolamide (AEA) and Various Levels Of Methoxy-2-propyl Ester of Example 2

| Samples | Lubricity Number (n = 6) | Standard Deviation | Wear Scar Area (n = 6) ($mm^2$) | Standard Deviation ($mm^2$) | Coefficient of Friction (n = 6) | Standard Deviation |
|---|---|---|---|---|---|---|
| ULSD | 0.622 | 0.048 | 0.360 | 0.022 | 0.123 | 0.005 |
| ULSD & 100 ppm AEA | 0.758 | 0.028 | 0.307 | 0.011 | 0.117 | 0.001 |
| ULSD & 100 ppm AEA & 0.1% methoxy-2-propyl ester of Example 2 | 0.892 | 0.038 | 0.270 | 0.013 | 0.114 | 0.002 |
| ULSD & 100 ppm AEA & 0.2% methoxy-2-propyl ester of Example 2 | 0.899 | 0.038 | 0.261 | 0.010 | 0.117 | 0.002 |

TABLE 4

EFFECT OF MTBE ON LUBRICITY CHARACTERISTICS OF PRE-PRODUCTION ULTRA LOW SULPHUR DIESEL FUEL COMBINED WITH 100 PPM AEA AND VARIOUS LEVELS OF METHOXY-2-PROPYL ESTER OF EXAMPLE 2

| Samples | Lubricity Number (n = 6) | Standard Deviation | Wear Scar Area (n = 6) (mm) | Standard Deviation ($mm^2$) | Coefficient of Friction (n = 6) | Standard Deviation |
|---|---|---|---|---|---|---|
| ULSD & 100 ppm AEA | 0.758 | 0.028 | 0.307 | 0.011 | 0.117 | 0.001 |
| ULSD & 100 ppm AEA & 0.025% MTBE | 0.793 | 0.040 | 0.297 | 0.013 | 0.116 | 0.001 |
| ULSD & 100 ppm AEA & 0.05% MTBE | 0.880 | 0.048 | 0.262 | 0.014 | 0.119 | 0.001 |
| ULSD & 100 ppm AEA & 0.025% MTBE & 0.075% methoxy-2-propyl ester of Example 2 | 0.848 | 0.033 | 0.283 | 0.010 | 0.114 | 0.001 |

TABLE 4-continued

EFFECT OF MTBE ON LUBRICITY CHARACTERISTICS OF PRE-PRODUCTION ULTRA LOW SULPHUR DIESEL FUEL COMBINED WITH 100 PPM AEA AND VARIOUS LEVELS OF METHOXY-2-PROPYL ESTER OF EXAMPLE 2

| Samples | Lubricity Number (n = 6) | Standard Deviation | Wear Scar Area (n = 6) (mm) | Standard Deviation ($mm^2$) | Coefficient of Friction (n = 6) | Standard Deviation |
|---|---|---|---|---|---|---|
| ULSD & 100 ppm AEA & 0.05% MTBE & 0.15% methoxy-2-propyl ester of Example 2 | 0.893 | 0.028 | 0.272 | 0.008 | 0.113 | 0.001 |

TABLE 5

LUBRICITY CHARACTERISTICS OF PRE-PRODUCTION ULTRA LOW SULFUR DIESEL FUEL COMBINED WITH AEA (100 PPM) AND VARIOUS LEVELS OF METHOXY-2-PROPYL ESTER OF EXAMPLE 2 BY HFRR METHOD

| Samples | Major Axis (mm) | Minor Axis (mm) | Wear Scar Diameter (mm) |
|---|---|---|---|
| ULSD | 0.74 | 0.72 | 0.73 |
| ULSD & 100 ppm AEA | 0.62 | 0.55 | 0.59 |
| ULSD & 100 ppm AEA & 0.1% methoxy-2-propyl ester of Example 2 | 0.52 | 0.48 | 0.50 |
| ULSD & 100 ppm AEA & 0.2% methoxy-2-propyl ester of Example 2 | 0.54 | 0.47 | 0.50 |

TABLE 6

Effect of MTBE On Lubricity Characteristics of Pre-Production Ultra Low Sulphur Diesel Fuel Combined With 100 ppm AEA and Various Levels Of Methoxy-2-propyl Ester of Example 2 by HFRR Method

| Samples | Major Axis (mm) | Minor Axis (mm) | Wear Scar Diameter (mm) |
|---|---|---|---|
| ULSD & 100 ppm AEA | 0.62 | 0.55 | 0.59 |
| ULSD & 100 ppm AEA & 0.025% MTBE | 0.69 | 0.64 | 0.66 |
| ULSD & 100 ppm AEA & 0.05% MTBE | 0.58 | 0.54 | 0.56 |
| ULSD & 100 ppm AEA & 0.025% MTBE & 0.075% methoxy-2-propyl Ester of example 2 | 0.56 | 0.50 | 0.53 |
| ULSD & 100 ppm AEA & 0.05% MTBE & 0.15% methoxy-2-propyl ester of Example 2 | 0.51 | 0.44 | 0.48 |

We claim:

1. A fuel additive composition comprising one or more hydrogen bonding compounds derived from a first long chain fatty acid, and one or more esters of a second long chain fatty acid, wherein the hydrogen bonding compounds and the esters are soluble in petroleum distillate fuels, the first and second long chain fatty acids are the same or different and the one or more hydrogen bonding compounds are present in the additive composition in an amount of from 10% to 99%, by weight, of the additive and are selected from:

(a) a first long chain fatty acid amine;

(b) a first long chain fatty acid amide, wherein the amide is an ethanolamide of the first long chain fatty acid, wherein the ethanolamide is produced from the reaction of ethanolamine and the first long chain fatty acid;

(c) a first long chain fatty acid imide, wherein the first long chain fatty acid comprises a conjugated diene and the imide is produced by a Diels-Alder reaction of a maleimide and the conjugated diene; and (d) a first long chain fatty acid polyol ester.

2. The composition according to claim 1, wherein the first long chain fatty acid is from a vegetable oil or animal fat.

3. The composition according to claim 2, wherein the vegetable oil is tall, soybean, canola, palm, sunflower, rapeseed, flaxseed, corn or coconut oil.

4. The composition according to claim 1, wherein the first long chain fatty acid that is reacted with ethanolamine is erucic acid.

5. The composition according to claim 1, wherein the imide of the first long chain fatty acid is produced from conjugated linoleic acid, conjugated linolenic acid or eleostearic acid.

6. The composition according to claim 1, wherein the maleimide is an N—$C_{1-6}$alkyl maleimide.

7. The composition according to claim 1, wherein the maleimide is an N-aryl maleimide.

8. The composition according to claim 7, wherein in the N-aryl maleimide is N-phenyl maleimide.

9. The composition according to claim 1, wherein the polyol is ethylene glycol, glycerol, diethylene glycol, triethylene glycol or polyethylene glycol.

10. The composition according to claim 1, wherein the second long chain fatty acid is from a vegetable oil or animal fat.

11. The composition according to claim 10, wherein the vegetable oil is tall, soybean, canola, palm, sunflower, rapeseed, flaxseed, corn, mustard seed, safflower, crambe or coconut oil.

12. The composition according to claim 11, wherein the vegetable oil is canola oil.

13. The composition according to claim 10, wherein the one or more esters of a second long chain fatty acid are $C_{1-6}$alkyl esters of the second long chain fatty acid.

14. The composition according to claim 13, wherein the $C_{1-6}$alkyl ester is a methyl ester.

15. The composition according to claim 10, wherein the esters of a second long chain fatty acid are aryl esters of the second long chain fatty acid.

16. The composition according to claim 10, wherein the esters of a second long chain fatty acid also comprise an ether in the ester moiety.

17. The composition according to claim 16, wherein the ether is a monoalkoxy ether derived from a glycol.

18. The composition according to claim 17, wherein the monoalkoxy ether is from methoxy-2-propyl alcohol.

19. The composition according to claim 10, wherein the esters of a second long chain fatty acid are cellosolve esters of the second long chain fatty acid.

20. The composition according to claim 19, wherein the cellosolve ester is butyl cellosolve.

21. The composition according to claim 10, wherein the esters of a second long chain fatty acid are carboxylic acid esters of a propylene ether and the second long chain fatty acid.

22. The composition according to claim 10, wherein the esters of a second long chain fatty acid are carboxylic acid esters of a polyether and the second long chain fatty acid.

23. The composition according to claim 22, wherein the polyether is a polyethylene glycol.

24. The composition according to claim 23, wherein the polyether is a polypropylene glycol.

25. The composition according to claim 10, wherein the one or more esters of a second long chain fatty acid are selected from compounds of Formula II:

(II)

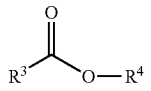

$R^3$ is selected from $C_{6-24}$alkyl, $C_{6-24}$alkenyl and $C_{6-24}$-alkynyl, all of which are unsubstituted or substituted with one to three substituents independently selected from halo, halo-substituted $C_{1-4}$alkyl, aryl, alkyl-substituted aryl and halo-substituted aryl; and $R^4$ is selected from $C_{1-6}$alkyl, $C_{1-6}$alkenyl, halo-substituted $C_{1-6}$alkyl, hydroxy-substituted $C_{1-6}$alkyl, alkoxy-substituted $C_{1-6}$alkyl, aryl, hydroxy-substituted aryl, alkoxy-substituted aryl, halo-substituted aryl and polyethers.

26. The composition according to claim 10 wherein the compound of Formula II is

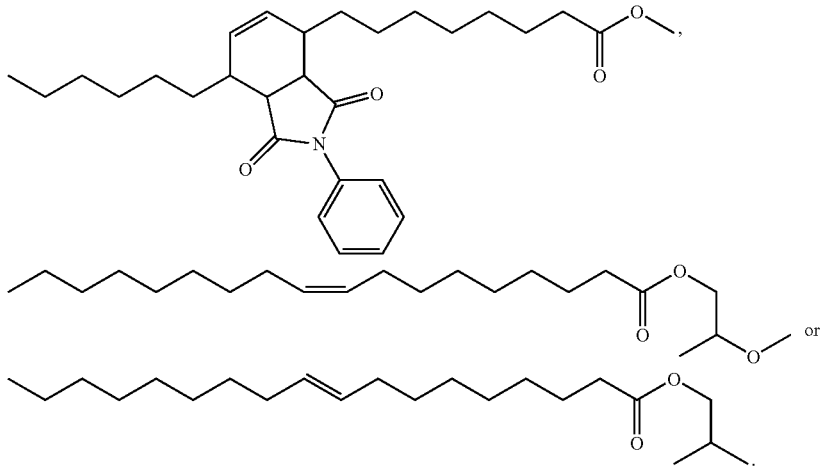

27. The composition according to claim 1, wherein the one or more ester-containing compounds are present in an amount from 1 to 90 percent by weight of the additive.

28. The compositions according to claim 1, wherein the composition further comprises a compound that lowers the freezing point, the cloud point and/or pour point of the composition.

29. The composition according to claim 25, wherein the compound is an ether.

30. The composition according to claim 29, wherein the ether is methyl tertiary-butyl ether.

31. The composition according to claim 1 further comprising a detergent.

32. A petroleum distillate fuel comprising the additive according to claim 1.

33. The fuel according to claim 32, wherein petroleum distillate fuel is selected from gasoline, diesel fuel, jet fuel, kerosene, biodiesel fuel, propane and ethanol containing fuel for gasoline engines.

34. The fuel according to claim 32 comprising a lubricating effective amount of the additive composition.

35. The fuel according to claim 34, comprising from about 0.001% to about 5% (v/v), of the additive composition.

36. A method for increasing the lubricity of a petroleum distillate fuel comprising adding a lubricating-effective amount of an additive composition according to claim 1 to said fuel.

37. The fuel according to claim 34, comprising from about 0.05% to about 0.2% (v/v), of the additive composition.

38. A fuel additive composition comprising one or more hydrogen bonding compounds derived from a first long chain fatty acid and one or more esters of a second long chain fatty acid, wherein the hydrogen bonding compounds and the esters are soluble in petroleum distillate fuels, the first and second long chain fatty acids are the same or different and the one or more hydrogen bonding compounds are present in the additive composition in an amount of from 10% to 99%, by weight, of the additive and are selected from compounds of a first long chain fatty acid amide, wherein the amide is an ethanolamide of the first long chain fatty acid, wherein the ethanolamide is produced from the reaction of ethanolamine and the first long chain fatty acid.

39. The composition according to claim 38, wherein the one or more hydrogen bonding compounds are selected from:

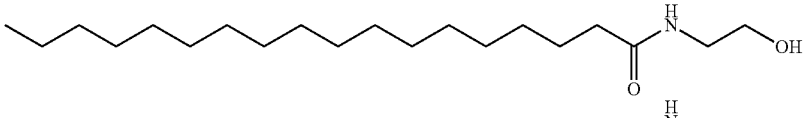

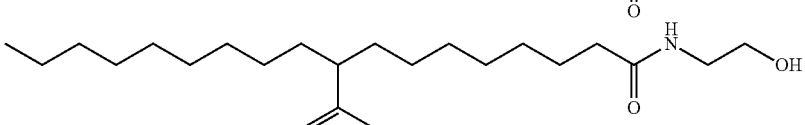

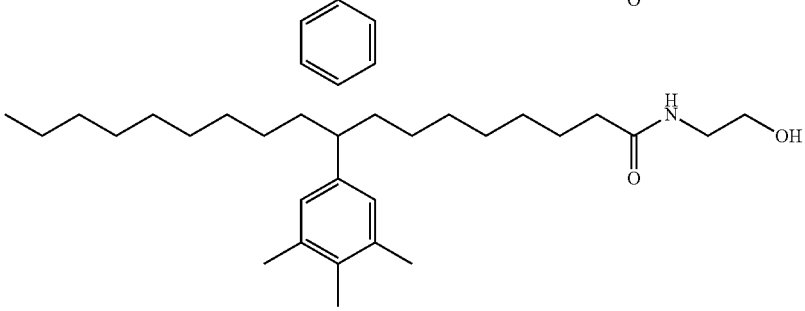

and

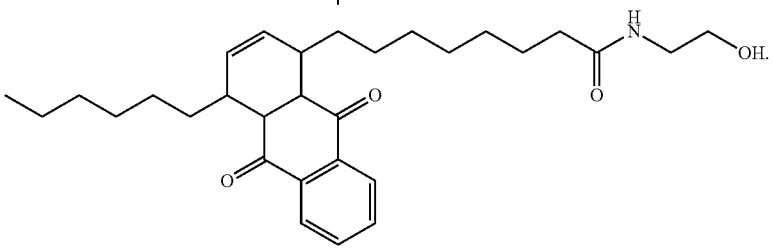

40. The composition according to claim 1, wherein the first and second fatty acid comprise a chain of 4 to 28 carbon atoms.

41. The composition according to claim 1, wherein the one or more hydrogen bonding compounds are present in the additive composition in an amount of from 10% to 50%, by weight, of the additive and the one or more ester-containing compounds are present in an amount from 50% to 90% by weight of the additive.

* * * * *